United States Patent [19]

Lentz

[11] Patent Number: 4,799,917

[45] Date of Patent: Jan. 24, 1989

[54] OSCILLATING HOOP AND STICK ASSEMBLY

[76] Inventor: Andrew O. Lentz, 1715 N. Bluff, Wichita, Kans. 67208

[21] Appl. No.: 135,671

[22] Filed: Dec. 21, 1987

[51] Int. Cl.[4] ..... A63H 33/02

[52] U.S. Cl. ..... 446/450

[58] Field of Search ..... 446/450, 451, 453, 236, 446/411, 452, 412, 413; D21/7, 9

[56] References Cited

U.S. PATENT DOCUMENTS

| | | | |
|---|---|---|---|
| 3,003,766 | 10/1961 | Stanton | 446/450 X |
| 3,494,069 | 2/1970 | Klimko | 446/450 |
| 3,596,380 | 8/1971 | Williams | 446/236 X |
| 3,758,984 | 9/1973 | Spransy et al. | 446/453 |
| 4,682,971 | 7/1987 | Washington | 446/450 |

*Primary Examiner*—Mickey Yu

*Attorney, Agent, or Firm*—Phillip A. Rein

[57] ABSTRACT

This invention relates to an oscillating hoop and stick assembly having an actuator stick assembly resembling a driver golf club structure having a lower hoop actuator member to contact a dual hoop assembly. The hoop actuator member is of generally C-shape having an outer hoop contact surface for moving a dual hoop assembly. The dual hoop assembly is provided with first and second hoop members interconnected by a connector assembly. The second hoop member is connected to the internal surface at a certain point on an outer periphery thereof to the first hoop member with a connector assembly which maintains their predetermined set relationship. A center axis of the first and second hoop members have a common point but the outer surfaces diverge outwardly therefrom so as to provide for offset relationship in the wobbling or oscillating movement thereof over a support surface to provide the novelty of this invention.

8 Claims, 1 Drawing Sheet

OSCILLATING HOOP AND STICK ASSEMBLY

PRIOR ART

A patent search on this invention revealed the following United States Patents:

| U.S. Pat. No. | Invention | Inventor |
|---|---|---|
| 1,272,240 | TOY HOOP | Tatsutaro Enomoto |
| 3,494,069 | ROLLING HOOP DEVICE | Joseph Klimko |
| 3,715,834 | HOOP-AND-STICK TOY | Avion P. L. Gelis |
| 3,758,984 | AMUSEMENT AND EXERCISE DEVICE | Spransy et al |
| 4,575,353 | COUNTERWEIGHTED AND SELF-EXTENDING MOBILE | Jerry Perkitny |
| 4,682,971 | STICK AND HOOP TOY | Leo Washington |

The Perkitny patent discloses a mobile structure but is not deemed pertinent to my invention.

The Washington patent discloses the use of two hoop members of unequal diameter with a stick for rotating same but are operable to be moved adjacent to each other.

The Gelis patent discloses a hoop and stick toy having a hoop with outer rail portions mountable within grooves in a head portion of a stick to achieve variable directional movement.

The Spransy et al patent discloses a pair of adjacent hoop structures of unequal diameters with a specially designed stick member to achieve an unusual type of movement.

The Klimko patent discloses a plurality of interacting hoop members operable to roll within each other in common vertical planes and, therefore, do not interact similar to my invention.

The Enomoto patent discloses a toy hoop having a stick structure with the hoop structure having a spiral construction from a single bamboo strip.

PREFERRED EMBODIMENT OF THE INVENTION

In one preferred embodiment of this invention, an oscillating hoop and stick assembly comprise an actuator stick assembly operable to contact and move a dual hoop assembly which is rolled along a support surface. The actuator stick assembly is provided with a hoop actuator member of generally C-shape interconnected to a rearwardly and vertically inclined operator handle member. The hoop actuator member is of a semi-circular configuration having an outer hoop contact surface for contacting the dual hoop assembly. The operator handle member is of generally cylindrical shaft shape and operable in an inclined manner similar to that of a golf club handle for proper operation thereof. The dual hoop assembly is provided with a first hoop member connected to a second hoop member by a connector assembly. The first and second hoop members are substantially identical being of a rectangular configuration in transverse cross section and having an outer flat surface to contact the support surface when being used as a game structure. The primary novelty is that the second hoop member is connected to the first hoop member by the connector assembly being anchor pin members. The first and second hoop members share one common diameter with the other respective diameters offset from one another. The diameter opposite the common diameter is offset at a desired angle (preferably 5-15 degrees) so as to give an oscillating or wobbly movement to the dual hoop assembly as it is propelled by the actuator stick assembly by the operator thereof thus achieving new and novel appearance and skill required relative to the ancient hoop and stick structure known to the prior art.

OBJECTS OF THE INVENTION

One object of this invention is to provide an oscillating hoop and stick assembly having an actuator stick assembly to move a dual hoop assembly along a support surface with the dual hoop assembly having an uneven outer configuration to obtain an oscillating or wobbly movement thus requiring greater skill for operation of this game structure.

Still, one other object of this invention is to provide an oscillating hoop and stick assembly having a new and novel dual hoop assembly with first and second hoop members interconnected so as to have a single common diameter.

One other object of this invention is to provide an oscillating hoop and stick assembly having an actuator stick assembly with a hoop guide section to contact a dual hoop assembly to move the same along a support surface requiring a certain amount of skill to do same thus making the game structure more desirable in the increased effort of maintaining the rotating dual hoop assembly within the control of the operator thereof.

Still, one further object of this invention is to provide an oscillating hoop and stick assembly which is rigid in construction; being easily understood in order to use the same; and provides a new and novel movement of a hoop assembly for the increased enjoyment thereof.

Various other objects, advantages and features of the invention will become apparent to those skilled in the art from the following discussion, taken in conjunction with the accompanying drawings, in which.

Figure 1:
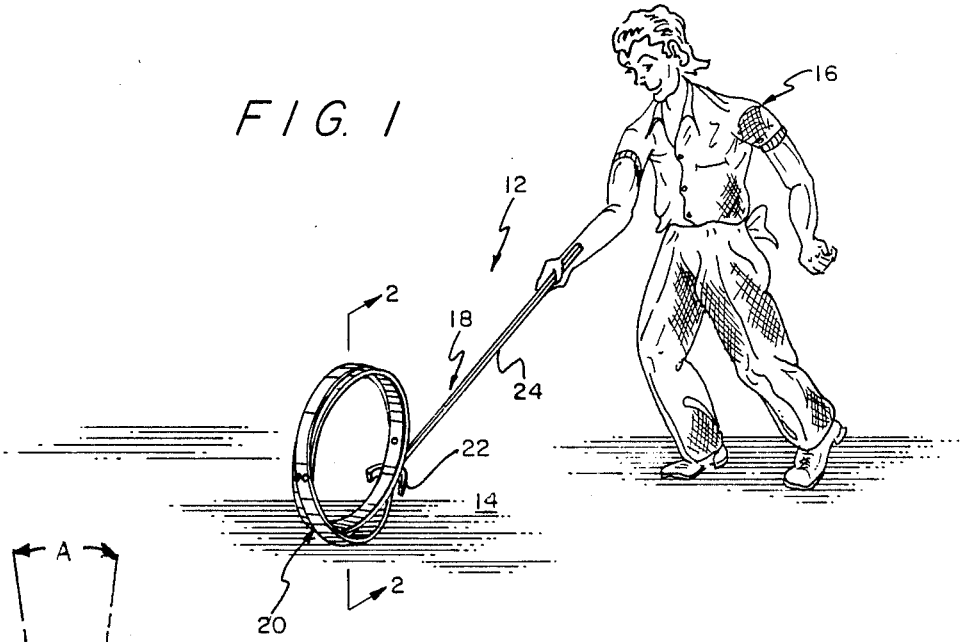
FIG. 1 is a perspective view of an oscillating hoop and stick assembly of this invention illustrated as being utilized by an operator for rolling a dual hoop assembly across a support surface.

The following is a discussion and description of a preferred specific embodiment of the new oscillating hoop and stick assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, an oscillating hoop and stick assembly of this invention, indicated generally at 12, comprises an actuator stick assembly 18 engagable with a dual hoop assembly 20 usable by an operator or game player 16 to move the dual hoop assembly 20 across a support surface 14.

The actuator stick assembly 18 includes a hoop actuator member 22 having an operator handle member 24 connected thereto so as to resemble a driver golf club member. The hoop actuator member 22 is provided with a hoop guide section 26 having a connector section 28 integral therewith. The hoop guide section 26 is of a generally C-shape being a section of a sphere having an outer contact surface 30 and a lower ground contact surface 32.

Figure 5:
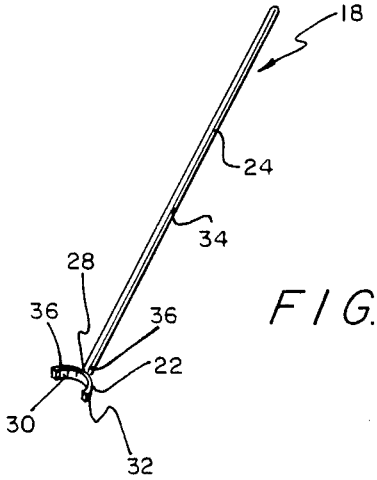
FIG. 5 is a perspective view of an actuator stick assembly of the oscillating hoop and stick assembly of this invention.

The operator handle member 24 resembles a cylindrical shaft having a handle section 34 with a connector section 36 at a lower end thereof. The connector sections 28, 36 are interconnected so as to present a rigid connection and an angular relationship from 30 to 45 degrees from a vertical axis of a horizontal plane of the ground contact surface 32 as illustrated in FIG. 5.

Figure 2:
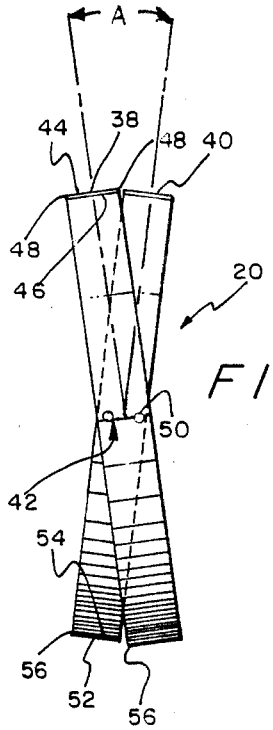
FIG. 2 is an enlarged sectional view taken along line 2—2 in FIG. 1 of the dual hoop assembly.
Figure 3:
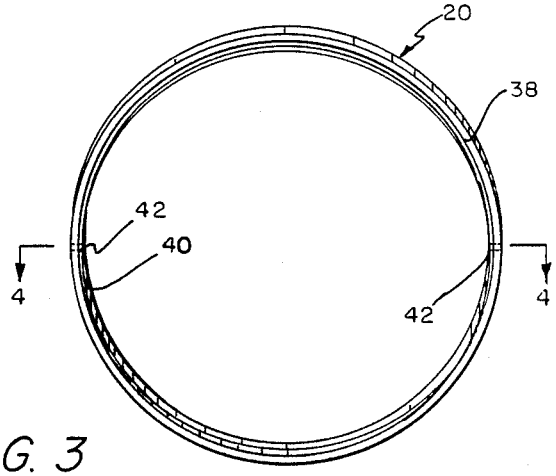
FIG. 3 is a side elevational view of the dual hoop assembly shown in FIG. 2 of this invention.

As best noted in FIG. 2, the dual hoop assembly 20 comprises (1) a first hoop member 38; (2) a second hoop member 40; and (3) a connector assembly 42 operable to connect said first hoop member 38 to said second hoop member 40 as will be noted.

The first hoop member 38 is provided with a first outer contact surface 44 and connected through first end wall surfaces 48 to a first inner surface 46. Additionally, first connector openings 50 namely, 3 thereof, are illustrated for receiving a portion of the connector assembly 42 therein as will be explained.

The second hoop member 40 is substantially identical to the first hoop member 38 having a second outer contact surface 52 interconnected by second end wall surfaces 56 to a second inner surface 54. Additionally, the second hoop member 40 is provided with second connector openings 58 which are adapted to be aligned in the assembled condition with the first connector openings 50 of the first hoop member 38 and connected thereto by the connector assembly 42.

The connector assembly 42 is provided with a plurality of anchor pin members 60 namely, 3 thereof, so as to be placed within aligned ones of the first connector openings 50 and the second connector openings 58.

Figure 4:
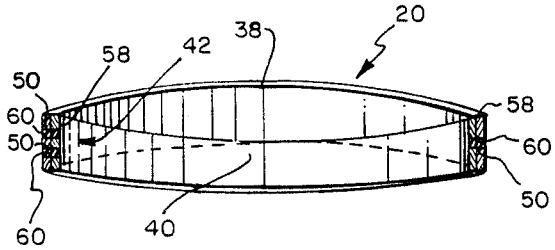
FIG. 4 is a sectional view taken along line 4—4 in FIG. 3.

The use of the three connector openings 50, 58 and the like number of anchor pin members 60 is shown in FIG. 4. It is obvious that at least this number of anchor pin members 60 are necessary to provide a rigid, nonmoving connection between the first hoop member 38 and the second hoop member 40 to achieve anchoring thereof in the condition as shown in FIG. 2. This positioning is important so that movement of the dual hoop assembly 20 across the support surface 14 due to an unbalanced weight thereof and, whether supported on the first outer contact surface 44 or the second outer contact surface 52, achieves a wobbling or oscillating movement. Additionally, movement of the dual hoop assembly 20 may be transferred during rotation from the first outer contact surface 44 to the second outer contact surface 52 and vice versa to achieve the unusual movements.

USE AND OPERATION OF THE INVENTION

In preparing for the use and operation of the invention, it is obvious that the dual hoop assembly 20 can be assembled in the condition of FIG. 2 by placing the second hoop member 40 within the inner confines of the first hoop member 38. Next, the first connector openings 50 are aligned with the second connector openings 58 and the anchor pin member 60 are inserted into respective ones of such aligned openings. The use of the three anchor pin members 60 with the three each connector openings 50, 58 provides an anchoring means to prevent relative movement therebetween and ease of assembly.

In the use of the oscillating hoop and stick assembly 12 as noted in FIG. 1, the dual hoop assembly 20 is first placed in a vertical condition and momentarily held by the game player 16 as he positions the actuator stick assembly in the inclined position as shown in FIG. 1. At this point, the game player 16 uses the hoop actuator member 22 with the operator handle member 24 connected thereto to contact an outer portion of the dual hoop assembly 20. The game player 16 then pushes forwardly on the dual hoop assembly 20 which will roll along the support surface 14. Due to the outer configuration and nature of the dual hoop assembly 20, the dual hoop assembly 20 would not tend to progress along the support surface 14 in a straight line but, in fact, would have a wobbling or oscillating movement thus requiring greater skill and effort to properly utilize and obtain enjoyment from the oscillating hoop and stick assembly 12 of this invention.

The dual hoop assembly 20, by its configuration, is unbalanced and rotational movement will tend to transfer support from the first contact surface 44 to the second contact surface 52. The angle of separation of the first and second hoop members 38, 40, as noted by letter "A" in FIG. 2, is shown as 15 degrees but may be varied between 5 to 20 degrees. The variation in the angle "A" will achieve different oscillating or wobbling movement and such variation will be dependent on the width of the first and second hoop members 38, 40. The minimum angle "A" will be determined by contact of the adjacent end wall surfaces 48 and 56.

It is seen that the oscillating hoop and stick assembly of this invention provides a new and novel movement of the dual hoop assembly which provides for the increased skill required and enjoyment of the game player utilizing same. The oscillating hoop and stick assembly is sturdy in construction; easy to assemble and disassemble; requires little instruction for use thereof; and provides additional skill and resultant enjoyment over the prior art structures of a hoop and stick toy structure.

While the invention has been described in conjunction with preferred specific embodiments thereof, it will be understood this description intended to illustrate not to limit the scope of the invention, which is defined by the following claims.

I claim:

1. An oscillating hoop and stick assembly, comprising:

(a) an actuator stick assembly having a hoop actuator member and a dual hoop assembly to be rolled along a support surface by said hoop actuator member;

(b) said dual hoop assembly having interconnected first and second hoop members secured to each other against relative movement having a single common diameter and all other diameters in said first hoop member offset in varying angular degrees from all other diameters in said second hoop member; and (c) said first and second hoop members each having outer contact surfaces, said second hoop member spaced a thickness of said first hoop member with respect to the support surface at the locations intersected by said common diameter to alternately engage the support surface to achieve a wobbling movement when rolling therealong.

2. An oscillating hoop and stick assembly as described in claim 1, wherein:

(a) said first and second hoop members each having another diameter offset 90 degrees from said common diameter with said another diameters offset from each other at an angle between 5 to 20 degrees and secured to each other in these relative positions.

3. An oscillating hoop and stick assembly as described in claim 2, wherein:

(a) said another diameter offset at an angle of 15 degrees to each other.

4. An oscillating hoop and stick assembly, comprising (a) an actuator stick assembly including a handle member secured at one end to a hoop actuator member and a dual hoop assembly to be rolled along a support surface by said hoop actuator member;

(b) said dual hoop assembly having interconnected first and second hoop members joined by a connector assembly, and having a single common diameter;

(c) said first and second hoop members having opposed connector openings forming a part of said connector assembly;

(d) said connector assembly further having anchor pin members mounted within respective ones of said connector openings to prevent relative movement between said first and second hoop members.

5. An oscillating hoop and stick assembly as described in claim 4, wherein:

(a) said first and second hoop members of ring shape and rectangular shape in transverse cross-section through one side of each of said hoop members, said hoop members having outer contact surfaces in overlapping relationships at the location intersected by said common diameter; whereby said first and second hoop members alternately engage the support surface when rolling therealong to achieve a wobbly movement.

6. An oscillating hoop and stick assembly as described in claim 4, wherein:

(a) one each of said connector openings and said pin members being in a common diametrical axis of said first and second hoop members.

7. An oscillating hoop and stick assembly, comprising:

(a) an actuator member and a dual hoop assembly to be rolled along a support surface by said hoop actuator member;

(b) said dual hoop assembly having interconnected first and second hoop members having a single common diameter and all other diameters in said first hoop member offset in varying angular degrees from all other diameters in said second hoop member;

(c) said dual hoop assembly includes a connector assembly to secure said first hoop member to said second hoop member against relative movement therebetween;

(d) said first and second hoop members having a plurality of opposed connector openings; and (e) said connector assembly having anchor pin members mounted within respective ones of said connector openings to prevent relative movement between said first and second hoop members.

8. An oscillating hoop and stick assembly as described in claim 7, wherein:

(a) at least one pair of said connector openings being substantially diametrically opposed to each other.

* * * * *